US012668945B2

(12) United States Patent
Fukuo et al.

(10) Patent No.: US 12,668,945 B2
(45) Date of Patent: Jun. 30, 2026

(54) AUTOMATIC LEVELING SYSTEM

(71) Applicant: KOBELCO CONSTRUCTION MACHINERY CO., LTD., Hiroshima (JP)

(72) Inventors: Nobuhiro Fukuo, Hiroshima (JP); Daisuke Noda, Hiroshima (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 576 days.

(21) Appl. No.: 18/044,605

(22) PCT Filed: Aug. 31, 2021

(86) PCT No.: PCT/JP2021/031853
§ 371 (c)(1),
(2) Date: Mar. 9, 2023

(87) PCT Pub. No.: WO2022/070728
PCT Pub. Date: Apr. 7, 2022

(65) Prior Publication Data

US 2023/0313489 A1 Oct. 5, 2023

(30) Foreign Application Priority Data

Sep. 29, 2020 (JP) ..... 2020-163623

(51) Int. Cl.
*E02F 3/43* (2006.01)
*E02F 9/26* (2006.01)

(52) U.S. Cl.
CPC ..... *E02F 3/436* (2013.01); *E02F 9/262* (2013.01); *E02F 3/434* (2013.01); *E02F 3/439* (2013.01)

(58) Field of Classification Search
CPC ... E02F 3/43; E02F 3/431; E02F 3/432; E02F 3/433; E02F 3/434; E02F 3/435;
(Continued)

(56) References Cited

U.S. PATENT DOCUMENTS 4,741,662 A * 5/1988 Schmiesing ..... E02F 3/342 414/718
5,542,781 A * 8/1996 Yemington ..... E02F 9/2045 37/414
(Continued)

FOREIGN PATENT DOCUMENTS

CN 1117317 A 2/1996
CN 104781478 A 7/2015
(Continued)

OTHER PUBLICATIONS

Extended European Search Report issued Feb. 5, 2024 in European Patent Application No. 21875031.3, 6 pages.
(Continued)

*Primary Examiner* — Ramya P Burgess
*Assistant Examiner* — Sara J Lewandroski
(74) *Attorney, Agent, or Firm* — Oblon, McClelland, Maier & Neustadt, L.L.P.

(57) ABSTRACT

Provided is an automatic leveling system restraining leveling-objects from collapsing. The automatic leveling system includes a work machine that performs leveling motion, an imaging device, and a controller. The imaging device acquires three-dimensional information about the shape and position of at least one of the leveling-objects and a peripheral object. The work machine is provided with a work attachment including a tip attachment. The controller sets a leveling area based on the acquired three-dimensional information and makes the work machine perform the leveling motion by the tip attachment within the leveling area.

12 Claims, 6 Drawing Sheets

(58) Field of Classification Search
CPC . E02F 3/436; E02F 3/437; E02F 3/438; E02F 3/439; E02F 9/26; E02F 9/261; E02F 9/262; E02F 9/264; E02F 9/265
See application file for complete search history.

(56) References Cited

U.S. PATENT DOCUMENTS

| | | | | |
|---|---|---|---|---|
| 5,908,458 | A * | 6/1999 | Rowe | E02F 3/437 701/50 |
| 2018/0171582 | A1 | 6/2018 | Yamada et al. | |
| 2018/0371723 | A1* | 12/2018 | Nishi | E02F 9/261 |
| 2019/0194912 | A1* | 6/2019 | Ishibashi | E02F 3/84 |
| 2020/0325649 | A1 | 10/2020 | Tsukamoto et al. | |
| 2021/0002851 | A1 | 1/2021 | Morita | |
| 2021/0002852 | A1* | 1/2021 | Nishi | E02F 9/2282 |
| 2021/0262190 | A1* | 8/2021 | Ito | E02F 9/205 |
| 2021/0292998 | A1 | 9/2021 | Kawamoto | |
| 2021/0292999 | A1* | 9/2021 | Hamada | G07C 5/0841 |
| 2022/0195690 | A1* | 6/2022 | Wu | E02F 3/437 |

FOREIGN PATENT DOCUMENTS

| | | | | |
|---|---|---|---|---|
| JP | 2000-64359 | A | 2/2000 | |
| JP | 2020-035380 | A | 3/2020 | |
| WO | WO-9307739 | A1 * | 4/1993 | E02F 3/20 |
| WO | WO 2017/010212 | A1 | 1/2017 | |
| WO | WO 2019/131979 | A1 | 7/2019 | |
| WO | WO2019/181872 | A1 | 9/2019 | |
| WO | WO2019/189013 | A1 | 10/2019 | |
| WO | WO 2020/095935 | A1 | 5/2020 | |

OTHER PUBLICATIONS

International Search Report issued Nov. 16, 2021 in PCT/JP2021/031853 filed on Aug. 31, 2021 2 pages.

Combined Chinese Office Action and Search Report issued Sep. 24. 2025 in Chinese Patent Application No. 202180063756.9 (with unedited computer-generated English translation of Office Action only), 12 pages.

* cited by examiner

AUTOMATIC LEVELING SYSTEM

TECHNICAL FIELD

The present invention relates to an automatic leveling system.

BACKGROUND ART

In Patent Literature 1 is described a technique for performing work related to debris by automatic operation of a work machine.

As described in FIGS. 2 and 7 of Patent Document 1, the debris may be placed in a heap. For example, the debris may be placed on the ground in a heap or loaded into a container (a vessel of a dump truck in Patent Document 1) in a heap. The debris thus placed in a heap may collapse. Similar problem is causable also when something other than debris is placed in a heap.

CITATION LIST

Patent Literature

Patent Literature 1: Japanese Unexamined Patent Publication No. 2000-64359

SUMMARY OF INVENTION

It is an object of the present invention to provide an automatic leveling system capable of automatically leveling a placed object to restrain it from collapsing.

Provided is an automatic leveling system for automatically leveling leveling-objects. The automatic leveling system includes a work machine capable of performing a leveling motion for leveling leveling-objects, an imaging device, and a controller. The work machine includes a lower traveling body, an upper turning body turnably supported by the lower traveling body, and a work attachment attached to the upper turning body capably of rising and falling. The work attachment includes an attachment body and a tip attachment. The attachment body has a distal end, being operable to move the distal end at least in an upper-turning-body front-rear direction. The upper-turning-body front-rear direction is a front-rear direction of the upper turning body. The tip attachment is held by the distal end of the attachment body, and the leveling motion is performed by movement of the tip attachment in contact with the leveling-objects. The imaging device acquires three-dimensional information about a position and a shape of at least one of the leveling-objects and a peripheral object around the leveling-objects. The controller is configured to set a leveling area based on the three-dimensional information detected by the imaging device and configured to make the work machine perform the leveling motion by the tip attachment within the leveling area.

DESCRIPTION OF EMBODIMENTS

There will be described a preferred embodiment of the present invention with reference to FIGS. 1 to 6.

Figure 1:
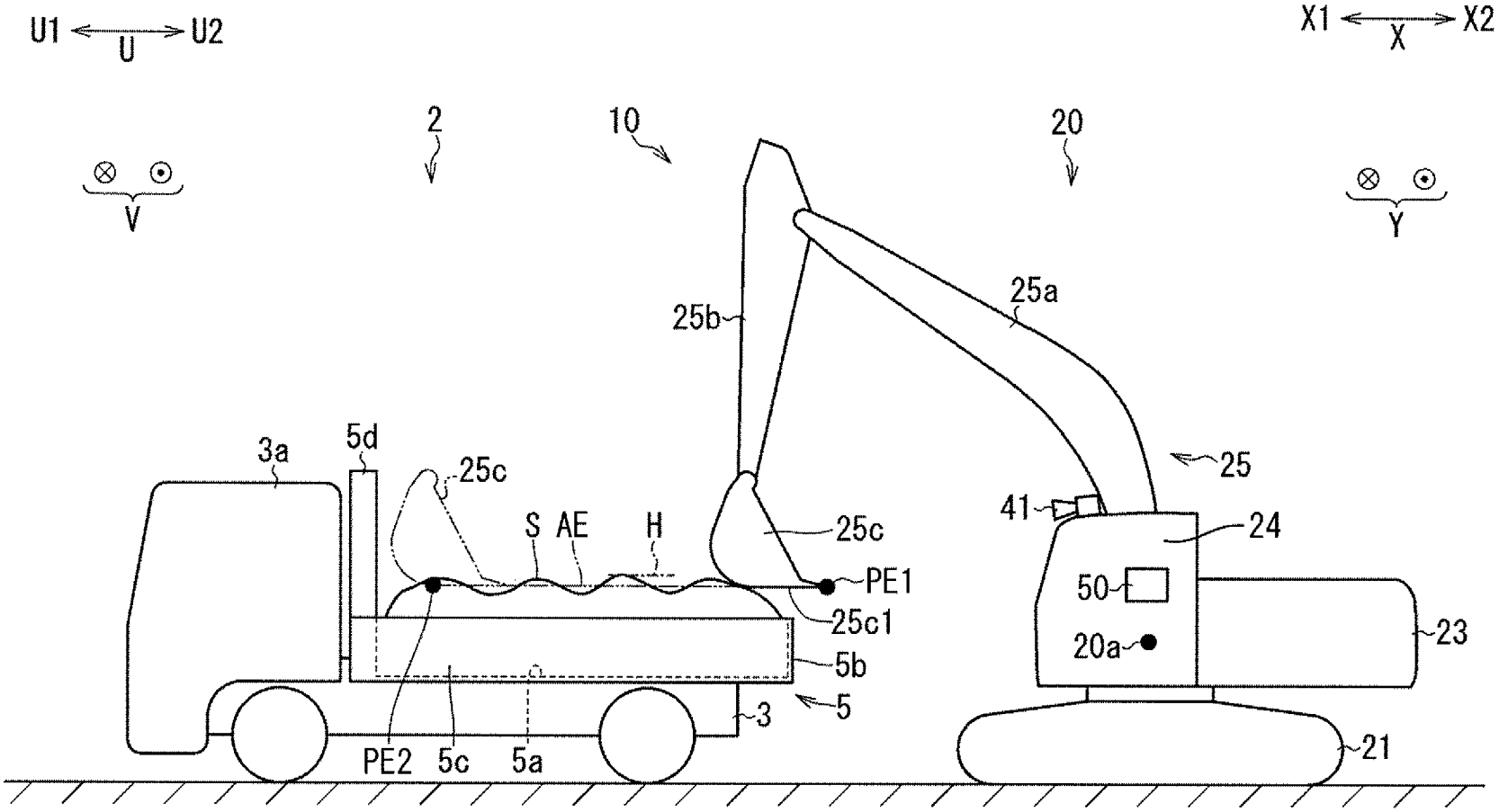
FIG. 1 is a side view showing a work machine of an automatic leveling system according to an embodiment of the present invention and a carriage truck on which leveling-objects are loaded.

FIG. 1 shows a work machine 20 included in an automatic leveling system 10 according to the embodiment and a carriage truck 2. The carriage truck 2 includes a truck body 3 and a container 5. The truck body 3 is capable of traveling and supports the container 5. The carriage truck 2 is capable of transporting the leveling-objects S that has been loaded in the container 5 by the work machine 20, by the traveling of the truck body 3. The carriage truck 2 may be either a dump truck or other track. The truck body 3 has a truck cab 3*a*.

The container 5 stores the leveling-objects S. The container 5 is, for example, a loading platform of the carriage truck 2. The container 5 may be either movable relatively to the truck body 3 or fixed to the truck body 3. The container 5 is not limited to the loading platform of the carriage truck 2. The container 5 may be one to be placed directly on the ground, such as a soil pit.

Figure 2:
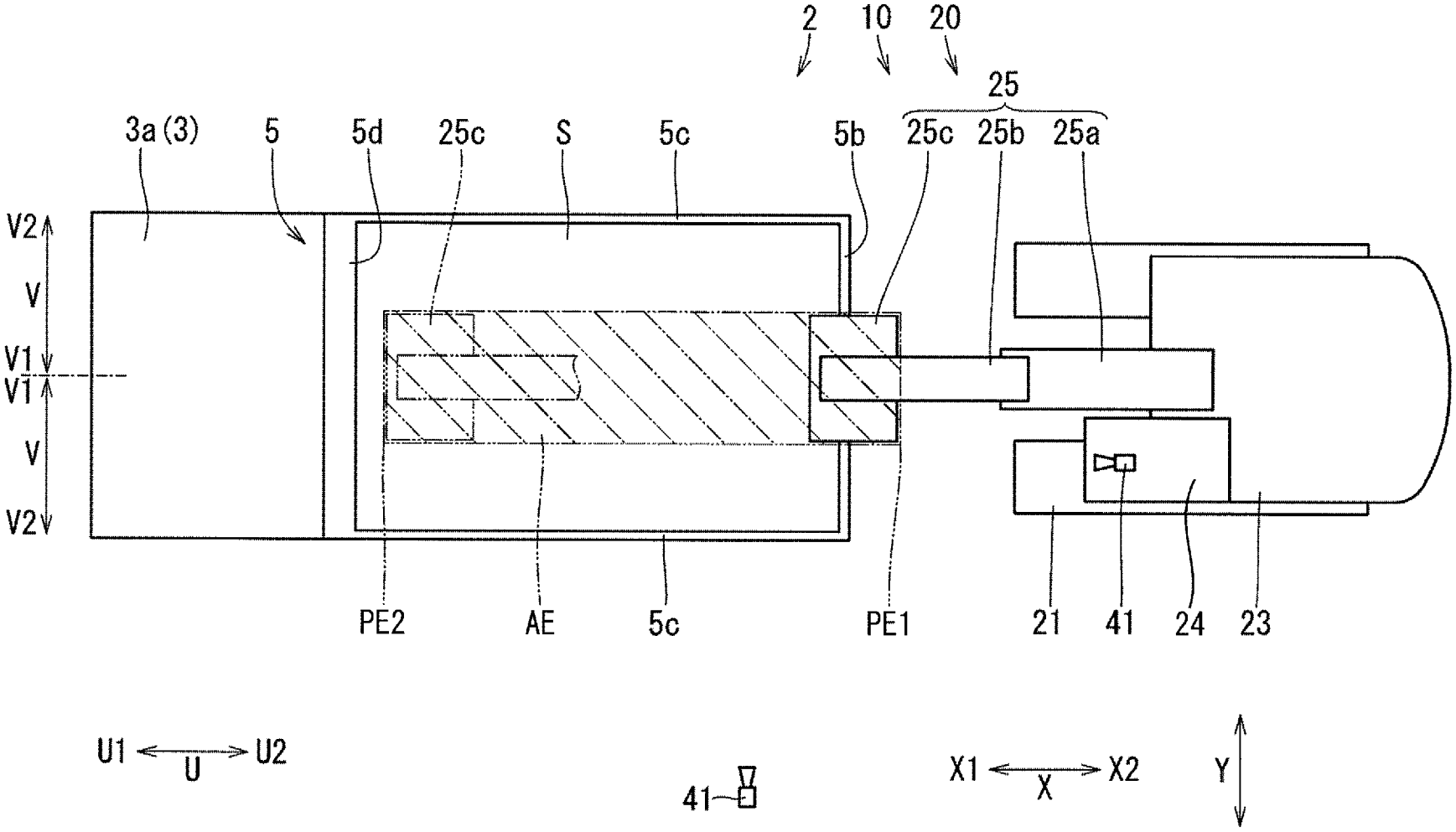
FIG. 2 is a plan view of the work machine and the carriage truck.

The container 5 has a container front-rear direction U and a container lateral direction V. The container front-rear direction U is a direction that is horizontal when the container 5 is placed on a horizontal plane, being the longitudinal direction of the container 5. The container front-rear direction U involves a container front side U1 and a container rear side U2, which are opposite sides to each other. In the present embodiment, the container front side U1 is a side of the container 5, on which side the truck cab 3*a* is located, and the container rear side U2 is a side of the truck cab 3*a*, on which side the container 5 is located. As shown in FIG. 2, the container lateral direction V is a direction that is horizontal when the container 5 is placed on a horizontal plane and orthogonal to the container front-rear direction U. The container lateral direction V involves a container inner side V1 and a container outer side V2, which are opposite sides to each other. The container inner side V1 is a side closer to the center with respect to the container lateral direction V of the container 5, and the container outer side V2 is farther from the center with respect to the container lateral direction V of the container 5.

The container 5 includes a container floor part 5*a*, a container rear part 5*b*, a pair of left and right container side parts 5*c*, and a container front part 5*d*.

The container floor part 5*a* is a lower part of the container 5 with respect to the vertical direction Z, namely, a bottom part. The container rear part 5*b* forms the end of the container 5 on the container rear side U2. The container rear part 5*b* protrudes upward from the end of the container floor part 5*a* on the container rear side U2. The container rear part 5*b* is, for example, a plate-like member which is, for example, a rear gate plate. The container rear part 5*b* has a plane or a substantial plane to which the container front-rear direction U is normal or substantially normal.

As shown in FIG. 2, the pair of container side parts 5*c* are respective ends of the container 5 on both outer sides V2 with respect to the container lateral direction V, namely, the left and right ends thereof. The pair of container side parts 5*c* protrude upward from respective ends of the container floor part 5*a* on both outer sides V with respect to the container lateral direction V, namely, the left and right ends. Each of the container side parts 5*c* is, for example, a plate-like member, which is, for example, a side gate plate. Each of the container side parts 5*c* has a plane or a substantial plane to which the container lateral direction V is normal or substantially normal.

As shown in FIG. 1, the container front part 5*d* is the end of the container 5 on the container front side U1. The container front part 5*d* protrudes upward from the end of the container floor part 5*a* on the container front side U1. The container front part 5*d* is, for example, a plate-like member, which is, for example, a gateway-like part. In the case where the container 5 is a loading platform, the container front part 5*d* protrudes upward beyond respective upper ends of the pair of container side parts 5*c* and the container rear part 5*b*. The container rear part 5*b* has a plane or a substantial plane to which the container front-rear direction U is normal or substantially normal.

The automatic leveling system 10 is a system for automatically leveling leveling-objects S, and the work machine 20 is capable of performing a motion for leveling the leveling-objects S, namely, a leveling motion. The leveling-objects S only has to be capable of being leveled, which is, for example, any of earth and sand, stone, and waste. The leveling-objects S is stored in the container 5, in the present embodiment, specifically placed on the container floor part 5*a*. The leveling-objects S, however, is not limited to ones to be stored in the container 5, but allowed to be placed directly on the ground or the like, for example, soil sand piled up on the ground.

Figure 3:
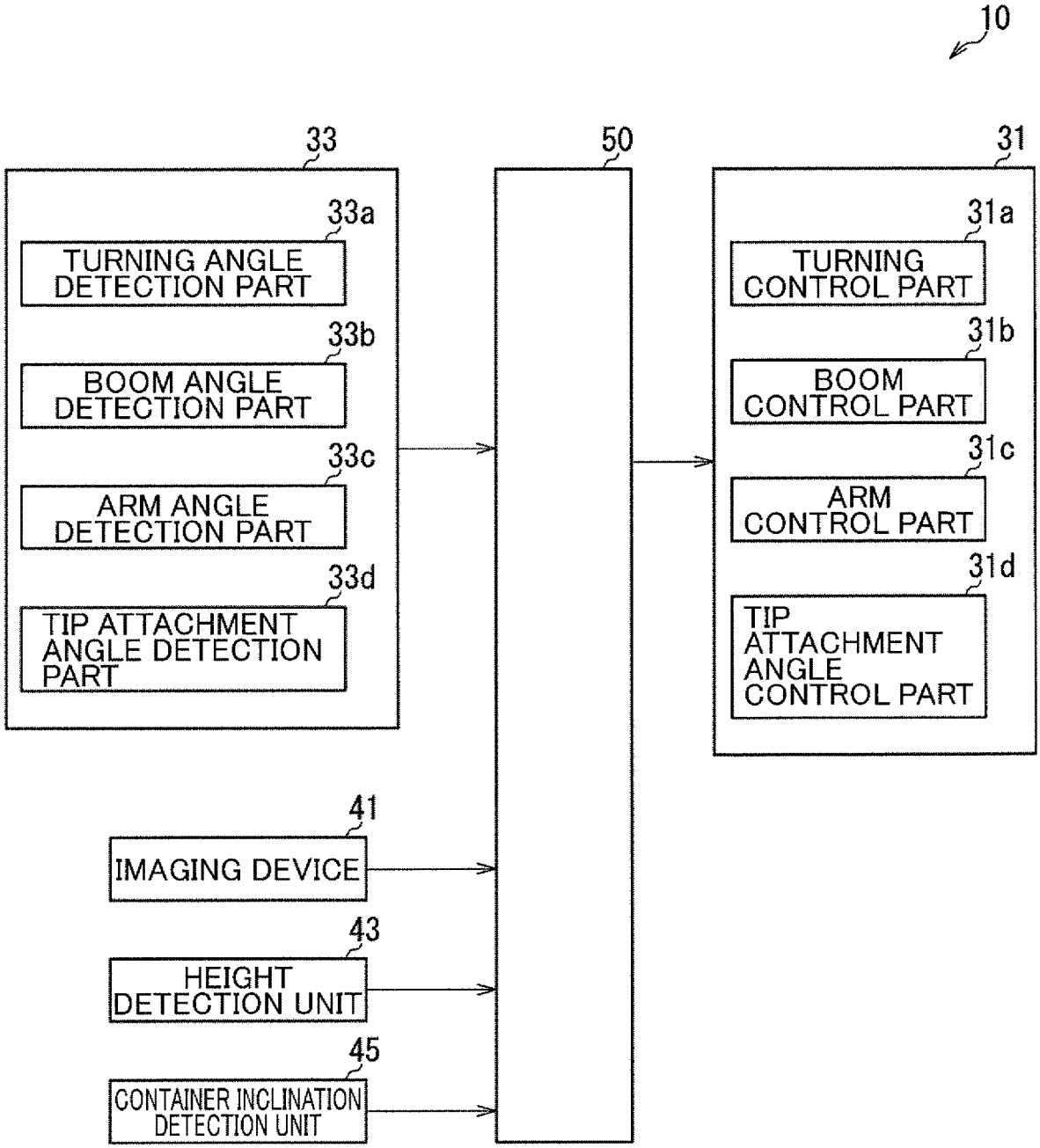
FIG. 3 is a block diagram showing the configuration of the automatic leveling system.

The automatic leveling system 10 includes, in addition to the work machine 20, a plurality of elements shown in FIG. 3, which include at least one imaging device 41, a height detection unit 43, a container inclination detection unit 45, and a controller 50.

The work machine 20 is a machine for performing work, for example, a construction machine for performing construction work, and the construction machine is, for example, an excavator. The work machine 20 is capable of performing a leveling motion, which is a motion to level leveling-objects S. The work machine 20 may be either dedicated to the leveling motion or capable of also other motions than the leveling motion. If being the excavator, the work machine 20 is capable of capturing the leveling-objects S (for example, excavation) and loading the captured leveling-objects S into the container 5 (for example, dump).

The work machine 20 includes a lower traveling body 21, an upper turning body 23, a work attachment 25, and a drive control unit 31 and a posture detection unit 33, which units are shown in FIG. 3.

The lower traveling body 21 supports the upper turning body 23 turnably. The lower traveling body 21 is capable of performing a traveling motion, which is a motion of traveling on the ground. The upper turning body 23 is mounted on the lower traveling body 21 capably of turning about a turning axis 26 shown in FIGS. 4 and 5 relatively to the lower traveling body 21. The turning axis 26 extends vertically, that is, in a depth direction in FIGS. 4 and 5.

The work attachment 25 is mounted on the upper turning body 23 capably of rising and falling, being capable of performing working motions including the leveling motion. The work attachment 25 includes an attachment body and a tip attachment 25*c*.

The attachment body includes a boom 25*a* and an arm 25*b*. The boom 25*a* has a boom proximal end and a boom distal end opposite thereto. The boom proximal end, corresponding to the proximal end of the attachment body, is attached to the upper turning body 23 capably of rising and falling, i.e., so as to be movable rotationally in a boom raising direction and a boom lowering direction about a lateral rotation axis. The arm 25*b* has an arm proximal end and an arm distal end opposite thereto. The arm proximal end is attached to the boom distal end of the boom 25*a* so as to be vertically movable rotationally about a lateral rotation axis, i.e., movable rotationally in an arm dump direction and an arm crowd direction. The arm distal end, corresponding to the distal end of the attachment body, can be moved by rising and falling movements of the boom 25*a* and the rotational movement of the arm 25*b*. The tip attachment 25*c* is held by the distal end of the attachment body, namely, the arm distal end of the arm 25*b* in the present embodiment, so as to be vertically rotationally movable to the arm 25*b*.

The tip attachment 25*c* includes a leveling part 25*c*1, which is a part capable of moving in contact with leveling-objects S to thereby level the leveling-objects S. The leveling part 25*c*1 includes a contact surface that is contactable with the leveling-objects S, the contact surface being, for example, a plane or a substantial plane. The tip attachment 25*c* illustrated in FIG. 1 is a bucket and the leveling part 25*c*1 is a bottom surface that is a substantially planar part of the bucket.

The upper turning body 23 has an upper-turning-body front-rear direction X and an upper-turning-body lateral direction Y. The upper-turning-body front-rear direction X is the front-rear direction of the upper turning body 23, being orthogonal to the turning axis 26 and orthogonal to the central axis of the rotational movement of the work attachment. The upper-turning-body front-rear direction X involves an upper-turning-body front side X1 and an upper-turning-body rear side X2. The upper-turning-body front side X1 is a side to which the attachment 25 protrudes from the upper turning body 23, and the upper-turning-body rear side X2 is opposite to the upper-turning-body front side X1. The upper-turning-body lateral direction Y is the upper-turning-body lateral direction 23, being orthogonal to the turning axis and parallel to the axis of the rotational movement of the work attachment 25.

The drive control unit 31 shown in FIG. 3 controls the drive of a plurality of not-graphically-shown actuators. The plurality of actuators include a turning motor for turning the upper turning body 23 relatively to the lower traveling body 21, and a plurality of extendable cylinders for moving the work attachment 25, the plurality of cylinders including: a boom cylinder for raising and lowering the boom 25*a*; an arm cylinder for rotationally moving the arm 25*b* to the boom 25*a*; and a tip attachment cylinder for rotationally moving the tip attachment 25*c* to the arm 25*b*. The drive control unit 31 includes a plurality of control units shown in FIG. 3, namely, a turning control part 31*a*, a boom control part 31*b*, an arm control part 31*c*, and a tip attachment control part 31*d*. The turning control part 31*a* controls the turning drive of the upper turning body 23 by the turning motor. The boom control part 31*b* controls the drive of the boom 25*a* by the boom cylinder. The arm control part 31*c* controls the drive of the arm 25*b* by the arm cylinder. The tip attachment control part 31*d* controls the drive of the tip attachment 25*c* by the tip attachment cylinder.

The posture detection unit 33 shown in FIG. 3 detects the posture of the work machine 20. The posture detection unit 33 includes, for example, a plurality of angle sensors. The posture detection unit 33, specifically, includes a turning angle detection part 33*a*, a boom angle detection part 33*b*, an arm angle detection part 33*c*, and a tip attachment angle detection part 33*d*. The turning angle detection part 33*a* detects a turning angle, which is the angle of the upper turning body 23 to the lower traveling body 21 shown in FIG. 1 in the turning direction. The boom angle detection part 33*b* detects a boom angle, which is the angle of the boom 25*a* to the upper turning body 23 in the rising and falling direction. The arm angle detection part 33*c* detects an arm angle, which is the angle of the arm 25*b* to the boom 25*a* in the rotational movement direction. The tip attachment angle detection part 33*d* detects a tip attachment angle, which is the angle of the tip attachment 25*c* to the arm 25*b* in the rotational movement direction.

The at least one imaging device 41 detects three-dimensional information about the position and shape of an imaging object. The imaging object is at least one of the leveling-objects S and a peripheral object, which is an object present around the leveling-objects S, for example, the container 5. The imaging device 41 acquires a distance image, which is an image containing distance information (depth information). The imaging device 41 is capable of, for example, acquiring the three-dimensional information of the imaging object based on the distance image and two-dimensional image.

The at least one imaging device 41 may include either only a single imaging device 41 or a plurality of imaging devices 41. Each of the imaging device 41, the height detection unit 43, the container inclination detection unit 45, and the controller 50 may be either installed on the work machine 20 or disposed on the outside of the work machine 20, for example, a work site. The at least one imaging device 41, if including an imaging device 41 disposed outside the work machine 20, may be able to acquire the three-dimensional information about a position about which the three-dimensional information cannot be acquired in a case where the at least one imaging device 41 includes only an imaging device 41 mounted on the work machine 20 (the above position is, for example, a position behind the attachment 25 when viewed from the imaging device 41). When including an imaging device 41 disposed outside the work machine 20, the at least one imaging device 41 allows even a work machine that is not inherently equipped with an imaging device to be applied to the automatic leveling system 10. When the three-dimensional coordinate system of the imaging device 41 and the three-dimensional coordinate system of the work machine 20 (machine coordinate system) are different from each other, performed is a processing of converting at least one of the two coordinate systems is converted to unify the coordinate systems.

The at least one imaging device 41 may include a device that acquires three-dimensional information of the imaging object by use of laser light, for example, LiDAR (Light Detection and Ranging or Laser Imaging Detection and Ranging) or a TOF (Time Of Flight) sensor. The at least one imaging device 41 may include a device that acquires the three-dimensional information by use of radio waves, for example, a millimeter wave radar. The at least one imaging device 41 may, alternatively, include a stereo camera. The at least one imaging device 41 may, alternatively, include a combination of a camera capable of acquiring a two-dimensional image and means for acquiring three-dimensional information about the position and shape of the imaging object based on the two-dimensional information and the distance information.

The at least one imaging device 41 according to the embodiment is provided on the upper surface of the cab 24 in the upper turning body 23 to acquire three-dimensional information about the position and shape of the container 5. The imaging device 41 may be configured either to acquire the three-dimensional information of the entire imaging object, whether the imaging object is the container 5 (i.e., the peripheral object) or the leveling-objects S, or to acquire three-dimensional information of only a part of the imaging object. The imaging device 41 shown in FIGS. 1 and 2 acquires three-dimensional information of at least the container rear part 5*b*, the pair of container side parts 5*c*, and the container front part 5*d* of the container 5. The acquisition of the three-dimensional information of the container floor part 5*a* is optional. The imaging device 41 may, for example, include means for detecting three-dimensional coordinates of a plurality of points that enable the shape of the container 5 to be identified, out of the points included in the container 5, for example, respective points at four corners of the container 5 viewed from above as shown in FIG. 2, and means for identifying the three-dimensional information of the container 5 based on the three-dimensional coordinates of the plurality of points.

The height detection unit 43 shown in FIG. 3 detects the height H of the leveling-objects S. The height H may be either the relative height of the leveling-objects S to the work machine 20 or the relative height of the leveling-objects S to the ground. For example, the height H may be the height of the leveling-objects S relative to a specific reference position 20*a* as illustrated in FIG. 1 in the work machine 20, that is, the vertical distance from the reference position 20*a* to the upper end of the leveling-objects S. The upper end of the leveling-objects S is, for example, the apex of the leveling-objects S when the leveling-objects S are formed into a heap. The reference position 20*a* is a position uniquely determined by the position of the upper turning body 23; for example, it may be either the position of a pivot of the proximal end of the boom 25*a* or a point included in the turning axis 26.

The height detection unit 43, alternatively, may be configured to determine the height H of the leveling-objects based on the position of the tip attachment 25*c* when the tip attachment 25*c* is pressed against the leveling-objects S. For example, the height H of the leveling-objects S may be calculated based on the position of the tip attachment 25*c* when the pressing force for pressing the tip attachment 25*c* against the leveling-objects S reaches a specified value. The pressing force can be determined, for example, based on the working pressure of at least one of a plurality of hydraulic cylinders that actuate the work attachment 25.

The height detection unit 43, alternatively, may be configured to determine the height H based on the three-dimensional information or the two-dimensional information of the leveling-objects S. The three-dimensional information or the two-dimensional information may be acquired by either the imaging device 41 or means other than the imaging device 41.

The container inclination detection unit 45 shown in FIG. 3 detects the inclination of the container 5. The container inclination detection unit 45 may detect the inclination of the container 5, for example, to either a horizontal plane or the ground on which the work machine 20 is disposed. The container inclination detection unit 45 may be configured to determine the inclination of the container 5 from the three-dimensional information or the two-dimensional information about the position and shape of the container 5. The three-dimensional information or the two-dimensional information may be acquired by either the imaging device 41 or other means than the imaging device 41. The container inclination detection unit 45 may, alternatively, be an inclination sensor attached to the container 5.

The controller 50 performs a plurality of operations, which include input/output of signals, processes such as judgment or calculation, storage of information, and the like. The plurality of operations, specifically, include calculation of a leveling area AE shown in FIG. 2 and control of the leveling motion of the work machine 20. The leveling area AE is an area within which the leveling motion should be performed. The controller 50 makes the drive control unit 31 perform a control operation on the basis of the posture of the work machine 20 detected by the posture detection unit 33, thereby achieving automatic control of the work machine 20.

The automatic leveling system 10 operates as follows.

The work machine 20 performs the leveling motion. The leveling motion is a motion for leveling the leveling-objects S, that is, a motion for flattening the upper part of the leveling-objects S, restraining the leveling-objects S from collapsing. For example, the motion of leveling the leveling-objects S stored in the container 5 restrains the leveling-objects S from collapsing when the leveling-objects S is transported while being stored in the container 5, thereby restraining the leveling-objects S from spilling out of the container 5. On the other hand, the motion of leveling the leveling-objects S placed on the ground restrains the leveling-objects S from being collapsed by its own weight, wind, etc.

The controller 50 sets the leveling area AE based on the three-dimensional information of the imaging object acquired by the imaging device 41. The leveling area AE is an area within which the tip attachment 25*c* performing the leveling motion, more specifically, the leveling part 25*c*1, passes. The leveling area AE includes a leveling start position PE1 and a leveling finish position PE2. The leveling start position PE1 is a position at which the leveling motion is started, and the leveling finish position PE2 is a position at which the leveling motion is finished. The controller 50 controls the motion of the work machine 20 so as to make the work machine 20 perform the leveling motion within the leveling area AE1. The controller 50, thus, controls the leveling motion. The controller 50 controls the motion of the work machine 20 so as to make the tip attachment 25*c* moved linearly from the leveling start position PE1 to the leveling finish position PE2. The leveling motion may be performed multiple times. For example, the second and subsequent leveling motions may continuously follow the finish of the first leveling motion. The leveling motion, alternatively, may be performed only once.

The controller 50, specifically, controls the leveling motion by making the drive control unit 31 perform a control operation. The controller 50 controls the leveling motion through the control of at least one of the motion of the work attachment 25 and the turning motion of the upper turning body 23. Each of the control of the motion of the work attachment 25 and the control of the turning motion is performed through the drive control unit 31. The controller 50 may control the leveling motion through the control of the traveling motion of the lower traveling body 21 in place of or in addition to the control of the motion of the work attachment 25 and the control of the turning motion.

The direction of the movement of the tip attachment 25*c* for the leveling motion, namely, a leveling direction, may be either an upper-turning-body front direction toward the upper-turning-body front side X1, or an upper-turning-body rear direction toward the upper-turning-body rear side X2. The upper-turning-body front direction is the direction of so-called push leveling, and the upper-turning-body rear direction is the direction of so-called crowd leveling. The leveling direction may contain a turning direction, which is the direction in which the upper turning body 23 is turned relatively to the lower traveling body 21. The leveling direction, i.e., the direction of the movement of the tip attachment 25*c*, when viewed from above as shown in FIG. 2, may be either the container front-rear direction U or a direction intersecting the container front-rear direction U, for example, the container lateral direction V.

The controller 50 can set the leveling area AE variously. Specific examples are following.

As to the setting of the leveling area AE by use of the three-dimensional information, there are the following setting examples 1A to 1E.

Setting Example 1A: the controller 50 sets the leveling area AE based on the three-dimensional information of the leveling-objects S placed on the ground.

Setting Example 1B: the controller 50 sets the leveling area AE based on the three-dimensional information of the leveling-objects S placed on the ground and the three-dimensional information of the peripheral object of the leveling-objects S, for example, the ground.

Setting Example 1C: the controller 50 sets the leveling area A based on the three-dimensional information of the leveling-objects S stored in the container 5.

Setting Example 1D: the controller 50 sets the leveling area AE based on the three-dimensional information of the container 5.

Setting Example 1E: the controller 50 sets the leveling area AE based on the three-dimensional information of the leveling-objects S stored in the container 5 and the three-dimensional information of the container 5.

The leveling area AE is preferably set so as to allow the leveling-objects S to be leveled as uniformly as possible. The leveling start position PE1 and the leveling finish position PE2 may be set at or near the periphery of the leveling-objects S when viewed from above as shown in FIG. 2. The leveling start position PE1 and the leveling finish position PE2 may be set in the vicinity of the periphery of the container 5 viewed from above, for example, in the vicinity of any of the container rear part 5*b*, the pair of container side parts 5*c*, and the container front part 5*d*.

FIGS. 1, 2, 4, and 5 show a case where the container front-rear direction U coincides with or substantially coincides with the container front-rear direction X and the tip attachment 25*c* is moved in the upper-turning-body front-rear direction X for the leveling motion, that is, a case where the push leveling or crowd leveling is performed. In this case, the controller 50 may set the position of the end of the leveling area AE to a position deviated (or offset) from the peripheral edge of the container 5, for example, any of the container rear part 5*b*, the pair of container side parts 5*c*, or the container front part 5*d*. For example, the controller 50 may set the position of the end of the leveling area AE with respect to the upper-turning-body front-rear direction X to a position deviated from the end of the container 5 in the upper-turning-body front-rear direction X, the end being the container rear part 5*b* or the container front part 5*d*.

As a setting example 2A, the leveling start position A1 may be set, for example, so as to restrain the leveling-objects S from spilling out of the container 5 in the upper-turning-body front-rear direction X at the leveling start position PE1 shown in FIG. 1. Specifically, the controller 50 may set the leveling start position PE1 on the outer side of the end of the container 5 in the upper-turning-body front-rear direction X, with respect to the upper-turning-body front-rear direction X. More specifically, the controller 50 may set the leveling start position PE1 to a position deviated from the end of the leveling area AE2 on the upper-turning-body rear side X2 (e.g., the container rear part 5*b*) to the upper-turning-body rear side X2. When the container 5 is not the loading platform of the carriage truck 2 but the container front part 5*d* is lower than the leveling-objects S, besides, the controller 50 may set the leveling start position PE1 at a position deviated from an end of the container 5 on the upper-turning-body front side X1 (e.g., the container front part 5*d*) to the upper-turning-body front side X1.

As a setting example 2B, the leveling area AE may be set so as to enable the tip attachment 25*c* to be restrained from contact with the container 5 at the leveling start position PE1 or the leveling finish position PE2. Specifically, the controller 50 may set the leveling start position PE1 or the leveling finish position PE2 to a position on the inner side of the end of the container 5 in the upper-turning-body front-rear direction X, with respect to the upper-turning-body front-rear direction X. More specifically, the controller 50 may set the position of the end of the leveling area AE on the upper-turning-body front side X1 to a position deviated from an end of the container 5 on the upper-turning-body front side X1 (e.g., the container front part 5*d*) to the upper-turning-body rear side X2.

The leveling start position PE1 and the leveling finish position PE2 in each of the setting example 2A and the setting example 2B are, for example, as follows. As seen from above, the leveling unit 25*c*1 is not a line or a point but a leveling operation surface having a specific area. In the leveling operation surface of the leveling unit 25*c*1 when the leveling motion is started, the position on the most upstream side with respect to the leveling motion is the leveling start position PE1. The leveling start position PE1, for example, in pushing leveling, is the end of the leveling operation surface on the upper-turning-body rear side X2. Similarly, in the leveling operation surface of the leveling unit 25*c*1 when the leveling motion is finished, the position on the most downstream side with respect to the leveling motion is the leveling finish position PE2. For example, in push leveling, it is the end of the leveling operation surface on the upper-turning-body front side X1.

The turning motion of the upper turning body 23 enables the leveling area AE to be expanded. For example, in the case where the dimension of the container 5 in the container lateral direction V, namely, the lateral width thereof, is significantly larger (e.g., twice or more) than the dimension of the tip attachment 25*c* shown in FIG. 2 in the upper-turning-body lateral direction Y, namely, the lateral width thereof, only a single performance of the leveling motion that involves moving the tip attachment 25*c* in the upper-turning-body front-rear direction X relatively to the upper turning body 23, namely, a front-rear leveling motion, may fail to level the leveling-objects S sufficiently. Also in such a case, by controlling the work machine 20 to alternately perform the front-rear leveling motion and the turning motion of the upper turning body 23 to the lower traveling body 21 to expand the leveling area AE in the container lateral direction V compared with the case of a single performance of the front-rear leveling motion, the controller 50 can allow the leveling-objects S to be leveled in a larger area. For example, the leveling area AE can be set over the entire or substantially entire interior of the container 5 when viewed from above, that is, can cover the entire interior of the container 5.

Figure 4:
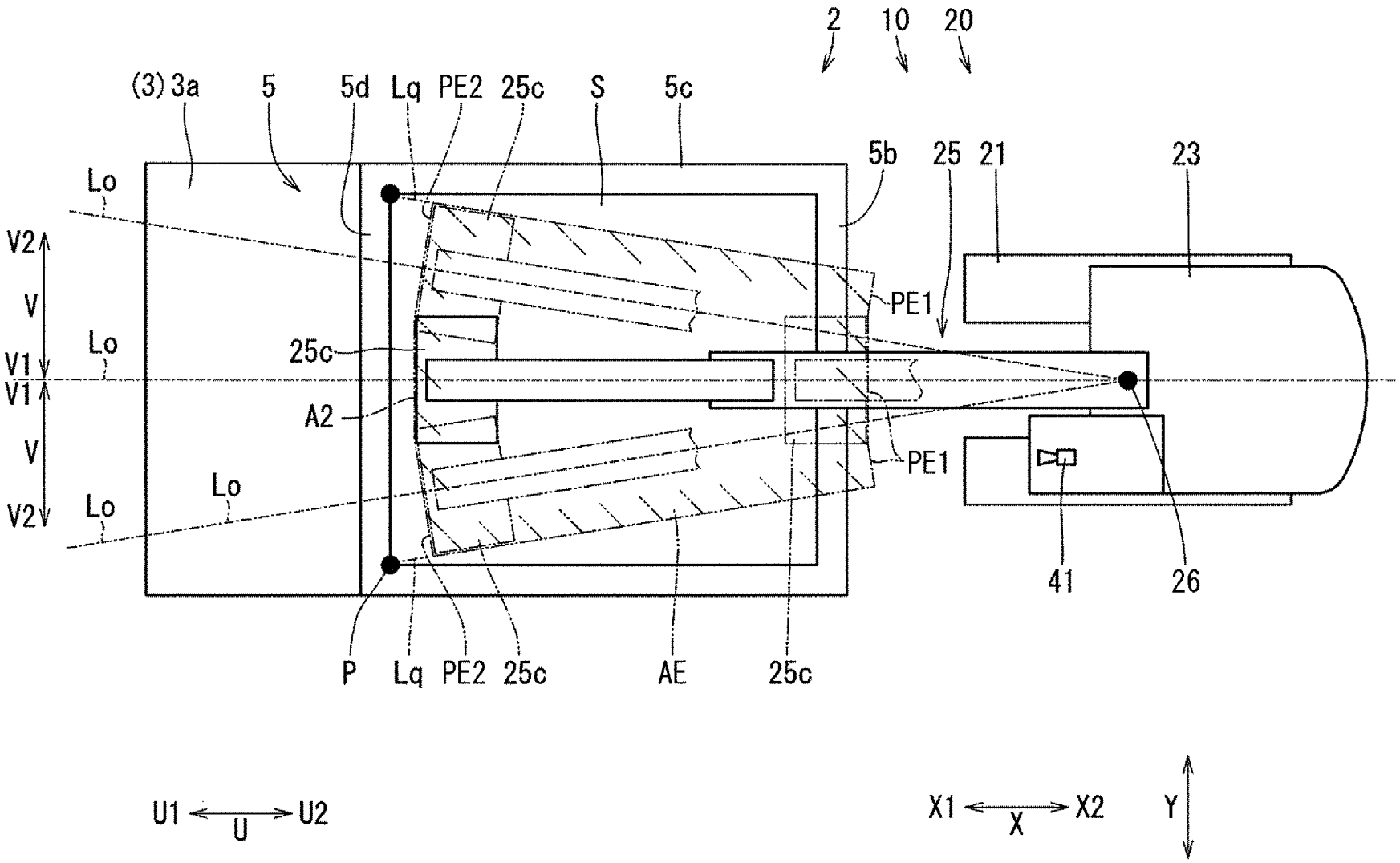
FIG. 4 is a plan view showing a leveling area in the case of alternate performance of the turning motion of the upper turning body and the leveling motion of the attachment of the work machine.

Specifically, for example, as shown in FIG. 4, the controller 50 makes the work machine 20 perform the first front-rear leveling motion, the turning motion, and the second front-rear leveling motion sequentially in this order. The controller 50 may further make it perform the second turning motion and the third front-rear leveling motion following the second front-rear leveling motion. Also the fourth and subsequent leveling motion can be added in a similar manner.

After leveling the leveling-objects S in the center area with respect to the container lateral direction V, the work machine 20 may be controlled to level the leveling-objects S in one of outer areas with respect to the container lateral direction V (for example, the right area) and then level the leveling-objects S in the other of outer areas with respect to the container lateral direction V (for example, the left area). The work machine 20, alternatively, may be controlled to level the leveling-objects S several times from one side (e.g., right side) to the other side (e.g., left side) in the container lateral direction V.

Figure 5:
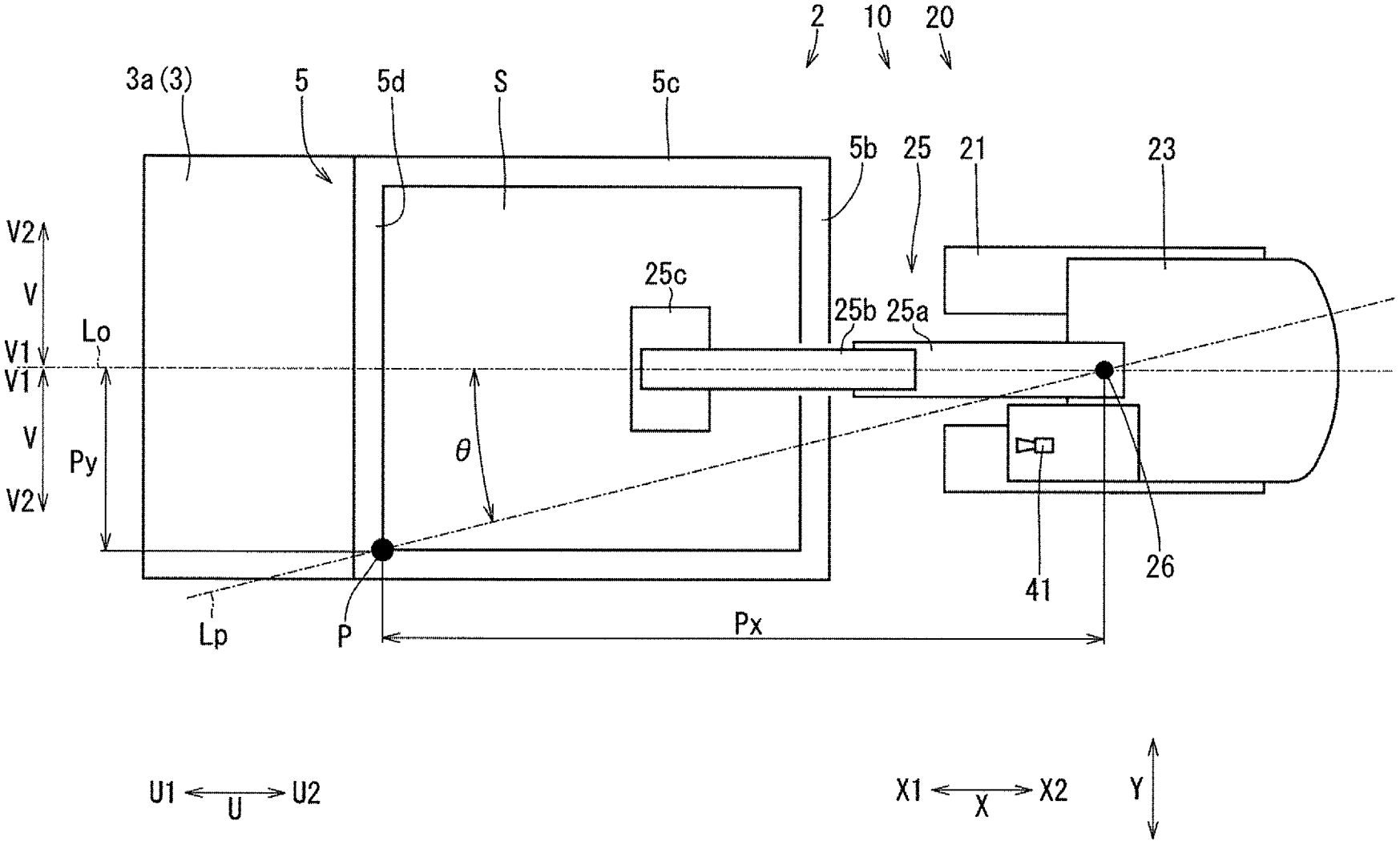
FIG. 5 is a plan view showing a target turning angle of the upper turning body, which angle is calculated in the automatic leveling system.

To allow the front-rear leveling motion and the turning motion to be alternately performed, the controller 50 sets the turning angle of the upper turning body 23 to the lower traveling body 21, for example, as follows. FIG. 5 shows straight-lines Lo, Lp and a point Ps that are assumed to determine the turning angle. The straight-line Lo extends to the upper-turning-body front side X1 through the turning axis 26 when viewed from above. The point Ps is the front apex of the container 5, located at the end on the container front side U1 (the upper-turning-body front side X1 in the arrangement shown in FIG. 5) and at the end on the outer side in the container lateral direction V. The point Ps is the left back point when viewed from the work machine 20. The coordinates of the point Ps based on the turning axis 26 as a reference, namely, machine coordinates, are (Px, Py, Pz). The straight-line Lp is a straight-line interconnecting the turning axis 26 and the point Ps when viewed from above. The angle θ formed between the straight-line Lo and the straight-line Lp when viewed from above can be calculated on the basis of the following formula: $\theta = \mathrm{Arctan}(Py/Px)$. The controller 50 performs: calculating, based on the angle θ, the target value of the turning angle of the upper turning body 23 to the lower traveling body 21, namely, a target turning angle; controlling the turning motion of the upper turning body 23 based on the target turning angle; and controlling the front-rear leveling motion of the attachment 25. This enables the leveling-objects S in the vicinity of the point Ps of the container 5 to be leveled. If the straight-line Lo is not coincident with the center axis of the attachment 25 as shown in FIG. 5 but deviated from the center axis of the attachment 25 in the upper-turning-body lateral direction Y, the controller 50 may set the turning angle in consideration of the deviation.

The leveling area AE can be set also based on the lateral width of the tip attachment 25*c*. The lateral width, which is the dimension of the tip attachment 25*c* in the upper-turning-body lateral direction Y, affects the necessity of alternate performance of the front-rear leveling motion and the turning motion and the possibility of the contact of the tip attachment 25*c* with any of the pair of container side parts 5*c*. The controller 50 may, hence, set the leveling area AE based on the lateral width of the tip attachment 25*c*. Preferably, the information about the lateral width of the tip attachment 25*c* is set into the controller 50. Examples of aspects of the setting include: input to the controller 50 through communication or the like; input to the controller 50 during the manufacture of the work machine 20 or the like;

and manual input to the controller 50 by operator. The information about the lateral width of the tip attachment 25*c* is acquirable from, for example, a distance image or a two-dimensional image. In this case, the image of the tip attachment 25*c* may be acquired by either the imaging device 41 or a sensor different from the imaging device 41.

As shown in FIG. 4, the controller 50 may set the leveling area AE, based on the lateral width of the tip attachment 25*c*, so as to prevent the tip attachment 25*c* from contact with each of the container side parts 5*c*. The controller 50 may set a turning angle of the upper turning body 23 for alternate performance of the front-rear leveling motion and the turning motion, on the basis of the lateral width of the tip attachment 25*c*. For example, the controller 50 may perform: calculating the angle θ shown in FIG. 5; correcting the calculated angle θ based on the lateral width of the tip attachment 25*c*; and letting the corrected value be the final target turning angle of the upper turning body 23. The controller 50, alternatively, may set the turning angle of the upper turning body 23 so as to make the straight-line Lq shown in FIG. 4 pass through the point Ps when viewed from above. The straight-line Lq is a straight-line that is parallel to the straight-line Lo and passes through the end of the tip attachment 25*c* with respect to the upper turning body lateral direction Y. The straight-line Lo is a straight-line extending to the upper-turning-body front side X1 through the turning axis 26, when viewed from above as described above.

The controller 50, alternatively, can set the leveling area AE with respect to the height direction, i.e., set the leveling height, based on the height H of the leveling-objects S detected by the height detection unit 43. For example, the controller 50 may set an area with respect to the height direction from the position of the apex of the leveling-objects S to the position lower than the apex by a predetermined height dimension, as the leveling height. Preferably, the predetermined height dimension is set into the controller 50. Examples of aspects of the setting include setting based on three-dimensional information of the leveling-objects S, input by an operator, input through communication, and the like. In the case where the height detection unit 43 detects the height H on the basis of a pressing force that presses the tip attachment 25*c* against the leveling-objects S, the controller 50 may set the leveling height based on the height of the tip attachment 25*c* when the pressing force reaches a specified value.

Figure 6:
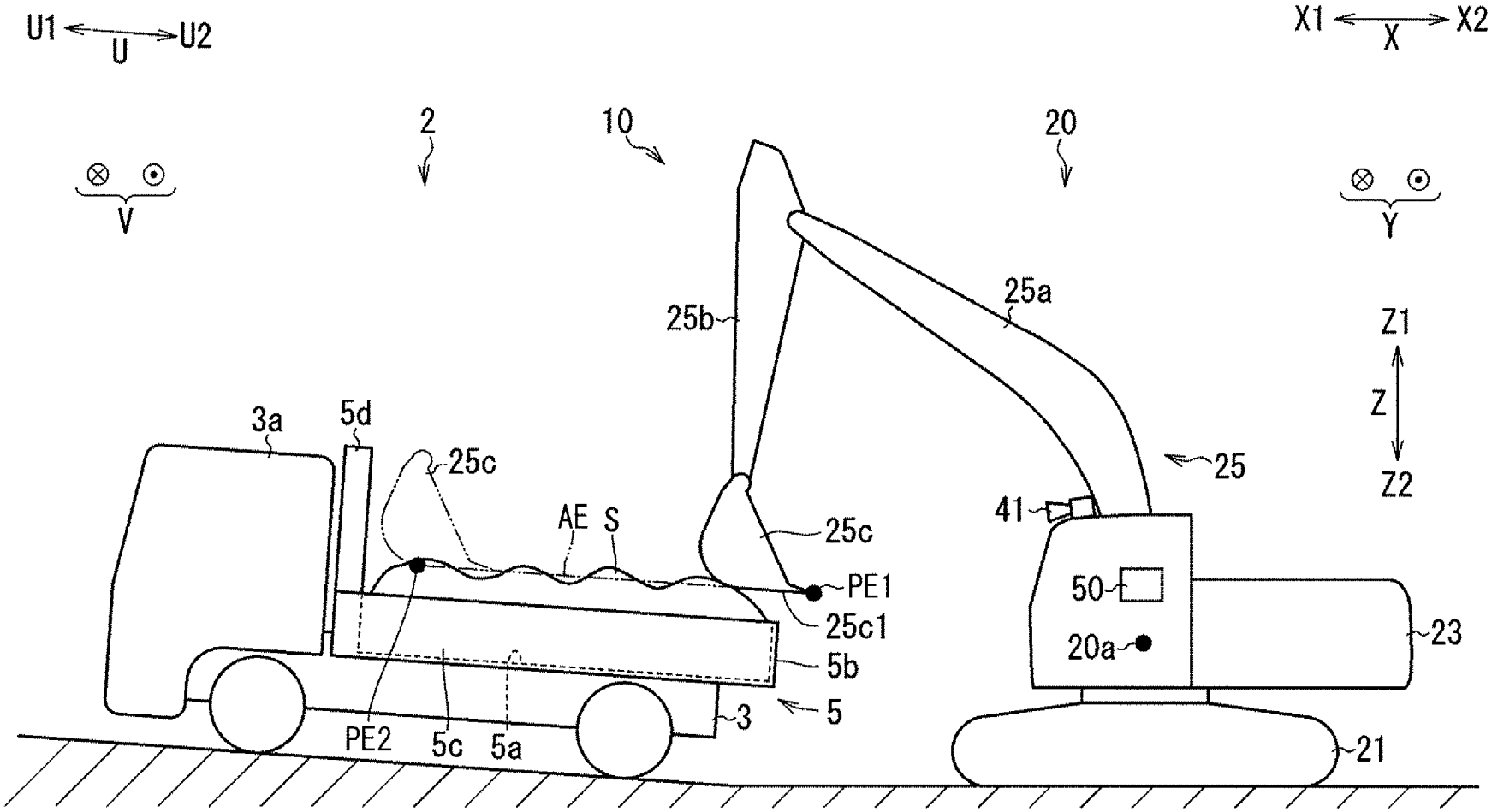
FIG. 6 is a side view showing a state where the carriage truck and the container thereof are inclined to the work machine shown in FIG. 1.

The controller 50 may set the leveling area AE based on the inclination of the container 5 detected by the container inclination detection unit 45. The inclination of the container 5 may be, for example, the inclination of the container 5 to either a horizontal plane or the ground on which the work machine 20 is placed as shown in FIG. 6. In this mode, the controller 50 may set the leveling area AE so as to make the leveling-objects S be leveled in a direction along the bottom surface of the container 5, that is, the upper surface of the container floor part 5*a*. The controller 50, preferably, sets the leveling area AE to an area parallel to the container floor part 5*a*.

An automatic leveling system is, thus, provided, being capable of automatically leveling placed leveling-objects to restrain the leveling-objects from collapsing. The automatic leveling system includes a work machine, an imaging device, and a controller. The work machine includes a lower traveling body, an upper turning body turnably supported by the lower traveling body, and a work attachment attached to the upper turning body capably of rising and falling. The work attachment includes an attachment body and a tip attachment. The attachment body has a distal end, being operable to move the distal end at least in an upper-turning-body front-rear direction. The upper-turning-body front-rear direction is a front-rear direction of the upper turning body. The tip attachment is held by the distal end of the attachment body, and the leveling motion is performed by movement of the tip attachment in contact with the leveling-objects. The imaging device acquires three-dimensional information about a position and a shape of at least one of the leveling-objects and a peripheral object around the leveling-objects. The controller is configured to set a leveling area based on the three-dimensional information detected by the imaging device and to make the work machine perform the leveling motion by the tip attachment within the leveling area.

The controller can set the leveling area appropriately, based on the three-dimensional information acquired by the imaging device. Furthermore, controlling the leveling motion by the work machine so as to make the tip attachment level the leveling-objects within the thus properly set leveling area, the controller enables the leveling-objects to be leveled in an appropriate position. Thus is achieved an automatic control of the leveling motion that restrains the leveling-objects from collapsing.

The peripheral object is, for example, a container that stores the leveling-objects. In this case, the controller is preferably configured to set the leveling area based on the three-dimensional information of the container. Leveling the leveling-objects thus stored in the container can restrain the leveling-objects stored in the container from collapsing and spilling out of the container.

Besides, less possibility of temporal change in the shape of the container than that in the shape of the leveling-objects allows the imaging device to detect the three-dimensional information of the container more easily and accurately than the three-dimensional information of the leveling-objects. On the basis of the three-dimensional information of the container, the controller can set the preferred leveling area more reliably than the basis of only the three-dimensional information of the leveling-objects contained in the container.

Preferably, the controller is configured to set the leveling area with respect to the upper-turning-body front-rear direction and configured to set the position of an end of the leveling area in the upper-turning-body front-rear direction to a position deviated in the upper-turning-body front-rear direction from an end of the container in the upper-turning-body front-rear direction. This enables the leveling-objects to be restrained from spilling out of the container and enables the tip attachment to be restrained from contact with the container, as compared with a case where the position of the end of the leveling area and the position of the end of the container are coincident with each other with respect to the upper-turning-body front-rear direction.

Preferably, the controller is configured to set a leveling motion start position at a position on an outer side of the end of the container with respect to the upper-turning-body front-rear direction, in the upper-turning-body front-rear direction. The leveling motion start position is a position of an end of the leveling area in the upper-turning-body front-rear direction, being a position at which the leveling motion is started. Thus setting the leveling motion start position enables the leveling-objects to be restrained from spilling out of the end of the container in the upper-turning-body front-rear direction to the outer side in the upper-turning-body front-rear direction.

The controller is preferably configured to set a position of a front end of the leveling area in the upper-turning-body front-rear direction to a position on a rear side of a front end of the container in the upper-turning-body front-rear direction. This allows the tip attachment to be restrained from contact with the front end of the container in the case where the front end of the container in the upper-turning-body front-rear direction protrudes upward beyond the leveling-objects.

Preferably, the automatic leveling system further includes a height detection unit that detects a height of the leveling-objects, wherein the controller is configured to set the leveling area with respect to the height direction based on the height of the leveling-objects detected by the height detection unit. This allows the leveling area to be set at an appropriate height corresponding to the height of the leveling-objects, thereby allowing the leveling-objects to be leveled at a more appropriate position to be restrained from collapsing.

Preferably, the automatic leveling system further includes a container inclination detection unit that detects an inclination of the container, wherein the controller is configured to set the leveling area so as to make the work machine level the leveling-objects in a direction along a bottom surface of the container, based on the inclination detected by the container inclination detection unit. This allows the leveling-objects to be leveled in a direction along the bottom surface of the container regardless of the inclination of the bottom surface, thereby allowing also the leveled portion of the leveling-objects to become horizontal or substantially horizontal when the bottom surface of the container is returned into a horizontal or substantially horizontal state, thus restraining the leveled portion from collapsing.

The controller is preferably configured to make the work machine perform a front-rear leveling motion and a turning motion alternately. The front-rear leveling motion is the leveling motion that involves moving the tip attachment in the upper-turning-body front-rear direction relatively to the upper turning body, and the turning motion is a motion of turning the upper turning body relatively to the lower traveling body. Such alternate performance of the front-rear leveling motion and the turning motion enables the leveling-objects to be leveled in a wider area than that in the case where only the front-rear leveling motion is performed while the turning angle of the upper turning body to the lower traveling body is kept constant.

Preferably, the controller is configured to set the leveling area with respect to an upper-turning-body lateral direction based on a lateral width of the tip attachment. The upper-turning-body lateral direction is a direction orthogonal to the upper-turning-body front-rear direction, and the lateral width is a dimension of the tip attachment in the upper-turning-body lateral direction. Setting the leveling area with respect to the upper-turning-body lateral direction allows the leveling area to be set at an appropriate position for the lateral width of the tip attachment.

The imaging device may be provided outside the work machine. Provision of the imaging device in the work machine may involve the location of the imaging object (at least one of the leveling-objects and the peripheral object) behind a component of the work machine (for example, the attachment) when viewed from the imaging device, whereas disposing the imaging device at an appropriate position outside the work machine can prevent the imaging object from being behind a component of the work machine when viewed from the imaging device to thereby allow the imaging object to be imaged. Besides, it allows a work machine inherently equipped with no imaging device to be applied to the automatic leveling system. This, however, does not intend to exclude an aspect in which another imaging device different from the above imaging device is provided in the work machine.

The embodiments described above may be variously modified. For example, the arrangement, shape, and connection of each component of the embodiment described above may be changed. For example, the number of components may be changed and some of the components may not be provided. For example, the fixation, connection, etc. of the components may be direct or indirect. For example, what has been described as a plurality of members or parts different from each other may be one member or part. For example, what has been described as one member or part may be provided separately in a plurality of members or parts different from each other. For example, the controller may be composed of either a single device or a plurality of devices.

The invention claimed is:

1. An automatic leveling system for automatically leveling leveling-objects, comprising:

a work machine capable of performing a leveling motion of leveling leveling-objects;

an imaging device that acquires three-dimensional information about a position and a shape of at least one of the leveling-objects and a peripheral object around the leveling-objects; and a controller that makes the work machine perform the leveling motion, wherein:

the work machine includes a lower traveling body, an upper turning body turnably supported by the lower traveling body, and a work attachment attached to the upper turning body capably of rising and falling, the work attachment including an attachment body having a distal end and being operable to move the distal end at least in an upper-turning-body front-rear direction and a tip attachment held by the distal end of the attachment body and being capable of leveling the leveling-objects by movement of the tip attachment in contact with the leveling-objects, the upper-turning-body front-rear direction being a front-rear direction of the upper turning body;

the controller is configured to set a leveling area based on the three-dimensional information detected by the imaging device and configured to make the work machine perform the leveling motion by the tip attachment within the leveling area;

the peripheral object is a container that stores the leveling-objects, and the controller is configured to set the leveling area based on the three-dimensional information of the container;

the controller is configured to set the leveling area with respect to the upper-turning-body front-rear direction and configured to set a position of an end of the leveling area in the upper-turning-body front-rear direction to a position deviated in the upper-turning-body front-rear direction from an end of the container with respect to the upper-turning-body front-rear direction; and the controller is configured to set a leveling motion start position to a position on an outer side of the end of the container with respect to the upper-turning-body front-rear direction, in the upper-turning-body front-rear direction, and the leveling motion start position is a position of an end of the leveling area with respect to the upper-turning-body front-rear direction, being a position at which the leveling motion is started.

2. The automatic leveling system according to claim 1, wherein the controller is configured to make the work machine perform a front-rear leveling motion and a turning motion alternately, the front-rear leveling motion being the leveling motion that involves moving the tip attachment in the upper-turning-body front-rear direction relatively to the upper turning body and the turning motion being a motion of turning the upper turning body relatively to the lower traveling body.

3. The automatic leveling system according to claim 1, wherein the controller is configured to set the leveling area with respect to an upper-turning-body lateral direction based on a lateral width of the tip attachment, the upper-turning-body lateral direction being a direction orthogonal to the upper-turning-body front-rear direction and the lateral width being a dimension of the tip attachment in the upper-turning-body lateral direction.

4. The automatic leveling system according to claim 1, wherein the imaging device is provided outside the work machine.

5. The automatic leveling system according to claim 1, wherein the controller is configured to set a position of a front end of the leveling area with respect to the upper-turning-body front-rear direction to a position on a rear side of a front end of the container with respect to the upper-turning-body front-rear direction.

6. An automatic leveling system for automatically leveling leveling-objects, comprising:

a work machine capable of performing a leveling motion of leveling leveling-objects;

an imaging device that acquires three-dimensional information about a position and a shape of at least one of the leveling-objects and a peripheral object around the leveling-objects;

a height detection unit that detects a height of the leveling-objects; and a controller that makes the work machine perform the leveling motion, wherein:

the work machine includes a lower traveling body, an upper turning body turnably supported by the lower traveling body, and a work attachment attached to the upper turning body capably of rising and falling, the work attachment including an attachment body having a distal end and being operable to move the distal end at least in an upper-turning-body front-rear direction and a tip attachment held by the distal end of the attachment body and being capable of leveling the leveling-objects by movement of the tip attachment in contact with the leveling-objects, the upper-turning-body front-rear direction being a front-rear direction of the upper turning body, the controller is configured to set a leveling area based on the three-dimensional information detected by the imaging device and configured to make the work machine perform the leveling motion by the tip attachment within the leveling area, the peripheral object is a container that stores the leveling-objects, and the controller is configured to set the leveling area based on the three-dimensional information of the container, and the controller is configured to set the leveling area with respect to a height direction from a position of an apex of the leveling-objects to a position lower than the apex by a predetermined height dimension, as a leveling height.

7. The automatic leveling system according to claim 1, further comprising a container inclination detection unit that detects an inclination of the container, wherein the controller is configured to set the leveling area so as to make the work machine level the leveling-objects in a direction along a bottom surface of the container, based on the inclination detected by the container inclination detection unit.

8. The automatic leveling system according to claim 6, wherein the controller is configured to make the work machine perform a front-rear leveling motion and a turning motion alternately, the front-rear leveling motion being the leveling motion that involves moving the tip attachment in the upper-turning-body front-rear direction relatively to the upper turning body and the turning motion being a motion of turning the upper turning body relatively to the lower traveling body.

9. The automatic leveling system according to claim 6, wherein the controller is configured to set the leveling area with respect to an upper-turning-body lateral direction based on a lateral width of the tip attachment, the upper-turning-body lateral direction being a direction orthogonal to the upper-turning-body front-rear direction and the lateral width being a dimension of the tip attachment in the upper-turning-body lateral direction.

10. The automatic leveling system according to claim 6, wherein the imaging device is provided outside the work machine.

11. The automatic leveling system according to claim 6, wherein the controller is configured to set a position of a front end of the leveling area with respect to the upper-turning-body front-rear direction to a position on a rear side of a front end of the container with respect to the upper-turning-body front-rear direction.

12. The automatic leveling system according to claim 6, further comprising a container inclination detection unit that detects an inclination of the container, wherein the controller is configured to set the leveling area so as to make the work machine level the leveling-objects in a direction along a bottom surface of the container, based on the inclination detected by the container inclination detection unit.

* * * * *